United States Patent [19]

Morohoshi et al.

[11] 4,204,400

[45] May 27, 1980

[54] ELECTRONIC METRONOME

[75] Inventors: Fumio Morohoshi; Yoshio Hasegawa, both of Tokyo, Japan

[73] Assignee: Kabushiki Kaisha Daini Seikosha, Japan

[21] Appl. No.: 846,396

[22] Filed: Oct. 28, 1977

[30] Foreign Application Priority Data

Oct. 28, 1976 [JP] Japan ..... 51-129673

[51] Int. Cl.[2] ..... G04F 5/02; G10B 15/00; G08B 3/00

[52] U.S. Cl. ..... 84/484; 340/384 E

[58] Field of Search ..... 58/130 R, 130 E; 84/484; 235/92 F, 92 T; 340/366 D, 366 R, 378 R, 384 E

[56] References Cited

U.S. PATENT DOCUMENTS

| | | | |
|---|---|---|---|
| 3,534,649 | 10/1970 | Anderson | 84/484 |
| 3,898,790 | 8/1975 | Takamune et al. | 58/23 BA |
| 4,018,126 | 4/1977 | Walman | 84/1.13 |
| 4,090,355 | 5/1978 | Morohoshi | 58/130 E |

*Primary Examiner*—Edith S. Jackmon

*Attorney, Agent, or Firm*—Robert E. Burns; Emmanuel J. Lobato; Bruce L. Adams

[57] ABSTRACT

An electronic metronome comprises a displaying means controlled by a down-beat signal and an up beat signal. And the displaying time of the down-beat signal is different from that of the up beat signal so that the down-beat signal is distinguished clearly from the up beat signal.

9 Claims, 3 Drawing Figures

ELECTRONIC METRONOME

BACKGROUND OF THE INVENTION

This invention relates to the rhythm displaying means of the electronic metronome, and particularly one in which rhythm displaying time depends on the strength thereof.

Conventionally, in systems for displaying rhythm of an electronic metronome by converting it to sound and light, tone, volume, light position and light are changed in accordance with down-beat and up beat.

But, according to the rhythmical sense of user it seems better that the down-beat is strongly displayed a little longer and up beat is weakly displayed for a shorter time interval.

SUMMARY OF THE INVENTION

Generally speaking, in accordance with this invention, an electronic metronome is provided with a tempo signal generator generating a predetermined frequency tempo signal, and means for developing a predetermined down-beat signal and up beat signal therefrom, and displaying means controlled by the down-beat signal and up beat signal distinguishes the down-beat from up beat by the respective time intervals for which they are displayed.

Accordingly, it is a general object of this invention to provide an electronic metronome which controls the sound and light displays for displaying the tempo with down-beat and up beat signals having different durations for distinguishing between down-beat and up-beat.

DESCRIPTION OF THE PREFERRED EMBODIMENTS

The invention is illustrated with accompanying drawings in detail.

Figure 1:
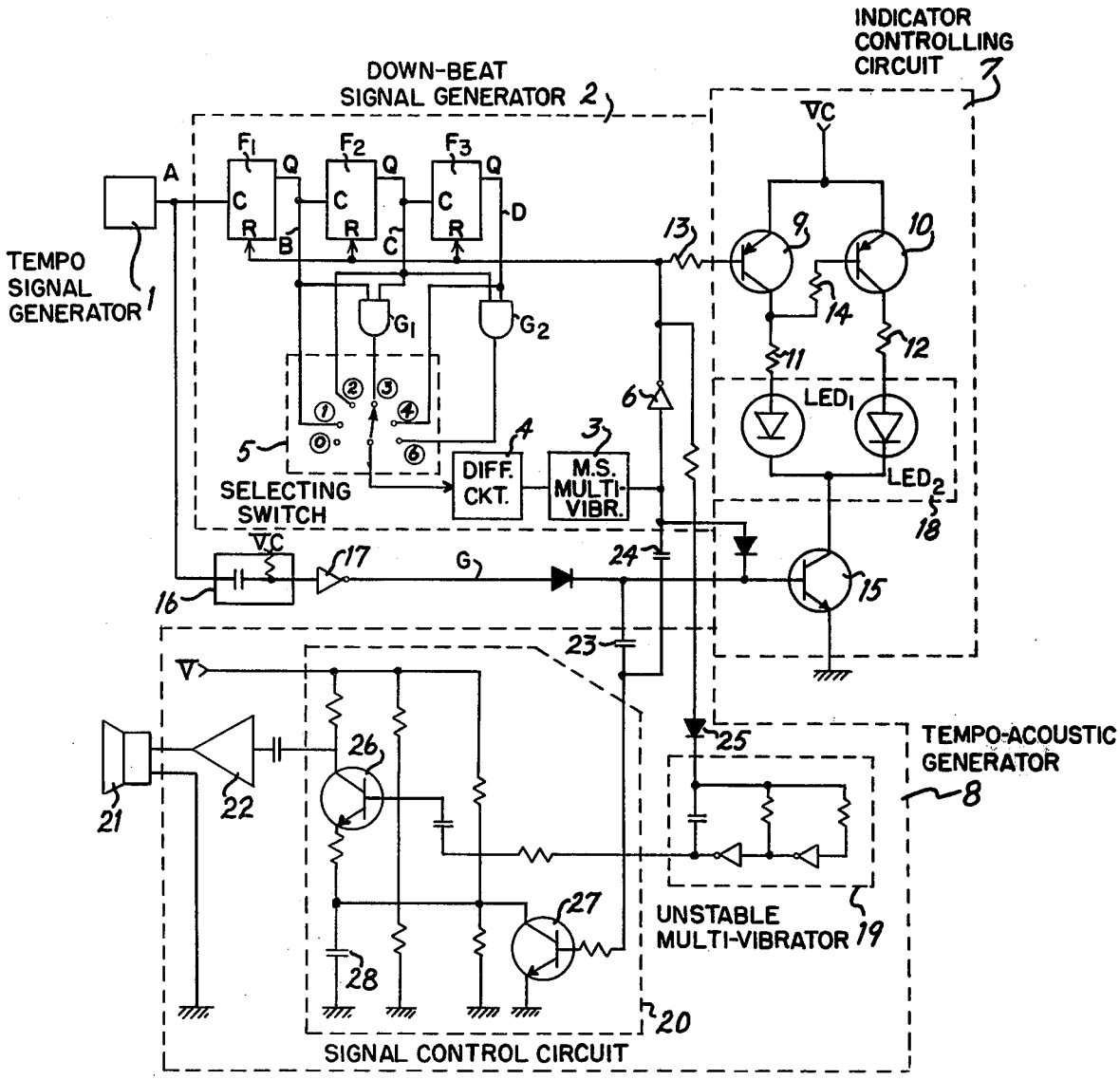
FIG. 1 is a circuit diagram of an embodiment of the electronic metronome according to the present invention.

Referring to FIG. 1, which is a circuit diagram showing one embodiment of the electronic metronome in accordance with the invention, 1 is a tempo signal generator of which an oscillating frequency is adjusted within a predetermined range and which produces a pulse signal at the adjusted frequency, namely a tempo signal A.

A down-beat signal generator 2 comprises three flip-flops $F_1$, $F_2$ and $F_3$, two AND gates $G_1$ and $G_2$, a mono-stable multivibrator 3, a differentiation circuit 4 and a tempo selecting switch 5.

The output of the flip-flops $F_1$, $F_2$ and $F_3$ is converted by a clock pulse signal fed to a trigger input terminal thereof at every falling edge of a clock pulse, and the flip-flops $F_1$, $F_2$, and $F_3$ are reset by a reset signal fed to a resetting terminal at every falling edge of a reset pulse. When tempo signal A is fed to the trigger input terminal C without applying the resetting signal to the resetting terminal, the flip-flops $F_1$, $F_2$ and $F_3$ operate in order and tempo signal A is divided successively and the frequency of the tempo signal A decreases as shown at signals B, C, and D in FIG. 2.

Any one of the output signals from the flip-flops $F_1$, $F_2$ and $F_3$ is selected by the tempo selecting switch 5 and is changed to a positive narrow pulse which is fed to the mono-stable multivibrator 3 by the differentiation circuit.

The output level of the mono-stable multivibrator 3 is normally a low level signal and is changed to high level signal having a pulse of 100 ms length by the leading edge of the positive narrow pulse input signal. The output pulse converted by a inverter 6 is fed to each respective resetting terminal R of the flip-flops $F_1$, $F_2$ and $F_3$ an indicator controlling circuit 7 described below and a tempo-acoustic generator 8 as the down-beat signal.

Figure 2:
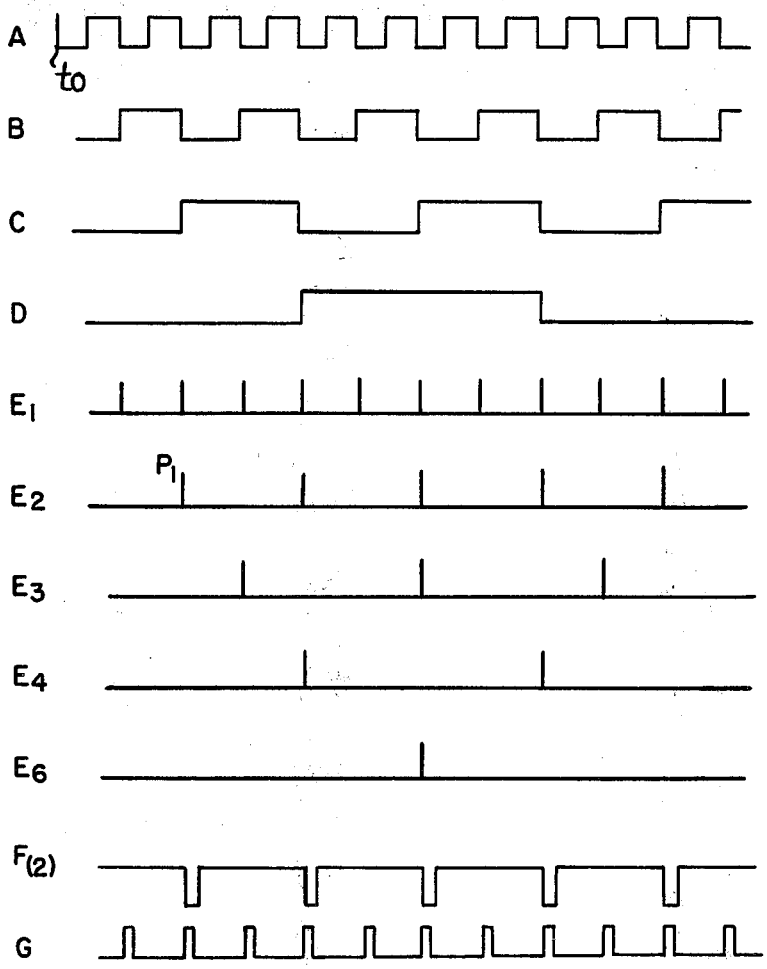
FIG. 2 is an illustration showing wave forms developed during operation of the metronome.

The selecting switch 5 is connected to a contact ② to get a down-beat signal of simple double time from the down-beat signal generator 2. Accordingly, as will be seen at c in FIG. 2, at the falling edge of the second tempo signal c, the output signal from flip-flop $F_2$ is applied to the differentiation circuit 4, and thus a pulse $P_1$ from the differentiation circuit shown at $E_2$ in FIG. 2 is fed to the mono-stable multivibrator 3. Therefore, the output terminal of the flip-flop $F_1$ is reset to its initial state by a down beat pulse of about 100 ms length obtained from the output terminal of inverter 6.

The down-beat signal is obtained from the differentiation circuit 4 at every second falling edge of the tempo signal by cyclic operation mentioned above (shown at $E_2$ in FIG. 2).

The selecting switch 5 is connected to the contact 4 to obtain the down-beat signal of quadruple time, that is, a pulse shown at $E_4$ in FIG. 2 and from differentiation circuit 4 at every leading edge (as shown at D in FIG. 2) of the signal from flip-flop $F_3$.

In like manner, the selecting switch 5 is connected to the contact 3 or 5 to feed the output signal from gate $G_1$ or $G_2$ to the differentiation circuit 4, that is to say, to obtain a simple triple time or sextuple time from the differentiation circuit 4 at every falling edge of the second or sixth tempo signal.

When the selecting switch is connected to a contact ⓪, the down-beat signal does not occur. And also when it is connected to a contact ①, the flip-flop F is reset by the first edge of the tempo signal whereby a pulse shown at $E_1$ in FIG. 2 is obtained from the differentiation circuit 4, that is to say, down-beat signal is obtained from down-beat signal generator in synchronism with the generation of the tempo signals.

Because the pulse length of the down-beat signal is determined by a characteristic of the mono-stable multivibrator 3, it is not changed by the variation of the tempo and a period of the tempo signal A.

An indicator controlling circuit is further explained in connection with the drawings.

A respective emitter of each of the transistors 9, 10 is connected to a common source and also a respective collector of each is connected to a respective input terminal of light emitting diodes $LED_1$, $LED_2$ through respective resistors 11, 12.

Further, a base of transistor 9 is connected to the inverter 6 through a resistor 13 and a base of transistor 10 is connected to the collector of the transistor 9 through the resistor 14.

A respective output terminal of each of the light emitting diodes $LED_1$, $LED_2$ is connected to a collector of the transistor 15 while an emitter of transistor 15 is grounded. And also the tempo signal A is applied to a base of transistor 15 through the differentiation circuit 16 and inverter 17 (shown at G in FIG. 2).

For a constant time when the tempo signal is low level, a high level signal is applied to the transistor 15 through a line G and the transistor 15 becomes conductive.

The transister 15 becomes conductive if a low signal level of the down-beat signal is applied to the base of the transistor 9 by the operation of the selecting switch 5. As the pulse length of down-beat signal pulses are broader than those of the tempo signal, when the down-beat signal is fed to the base of transistor 9, a current flows through the light emitting diode $LED_1$ for a pulse duration of the tempo signal, so the down-beat signal is displayed by light emitted from the $LED_1$.

But the light emitting diode $LED_2$ does not emit light since at this time the electric potential at the base of transistor 10 is raised by the current flowing through the resistor 11 and the transistor 10 becomes nonconductive. On the contrary, when the tempo signal is fed to the base of the transister 15, if the down-beat does not occur, the transister 9 does not become conductive whereby the $LED_1$ does not emit light. Because the current does not flow through the resistor 11, the electric potential of the base of transistor 10 drops while a current flows through the transister 10, and the $LED_2$ emits light and the up beat is displayed.

Above mentioned $LED_1$ and $LED_2$ are light emitting diodes which emit different color light.

Figure 3:
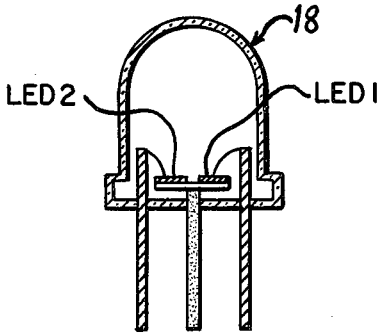
FIG. 3 is a section view of the metronome displaying means.

An indicator 18 is obtained by mounting chips of $LED_1$ and $LED_2$ closely in one package as shown in FIG. 3.

When the $LED_1$ is conductive its emission color is green for example. Similarly when the $LED_2$ is conductive, its emission light color is red for example.

Further a tempo-acoustic generator 8 will be described. It comprises an astable or unstable multivibrator 19 the frequency of which is controlled by the down-beat signal, and it is composed of two inverters, a signal control circuit 20 changing its oscillating output to a attenuation sound signal and an amplifier 22 for amplifying the output signal from the signal control circuit 20 to operate the loud speaker 21.

An output from said oscillator 19, i.e. a tempo-acoustic signal, is fed to a base of transistor 26 and also a tempo signal G is fed to a base of transistor 27. While the tempo signal G is fed to a base of transistor 27 the transistor 27 becomes conductive so the transistor 26 becomes conductive and the tempo-acoustic signal is fed to an amplifier 22 as the attenuation sound signal.

When the tempo- signal does not occur so that the transistor 27 becomes non-conductive, the conductive state of the transistor 26 is held to and decreases for a little time until a condenser 28 is charged. This attenuation duration is determined so that the rhythm of the speaker output is heard comfortably by selecting the time constant.

The down-beat signal is fed to a diode 25 through the inverter 6. An oscillating frequency of the oscillator 19 is changed by the output signal of the diode 25 and the down-beat acoustic signal is generated by the oscillator 19. On the otherhand, the down-beat signal from the monostable multivibrator 3 is fed to the base of transistor 27 through a condenser 24.

As above stated, since the pulse length of the down-beat signal is broader than that of the tempo-acoustic signal, an operating time or conduction time of transistor 26 is determined by the former length so the down-beat sound and up beat sound from the loud speaker are different in frequency or tone and in sound generating time or duration; that is to say a difference between the down-beat sound and the up beat sound is made very clear to allow the rhythm to be heard comfortably.

The above discribed embodiment of this invention is by way of example only and not limiting.

Therefore, the time displayed by the light can be changed with the time difference between the down-beat and up beat. And a wave shaping circuit for making a pulse length narrow can be replaced with a known circuit.

And also, the up beat signal can be produced directly from the tempo signal which does not include the down-beat signal.

As above stated, since the down-beat signal and up beat signal of which the pulse length is different are produced by this invention, the respective rhythm and the tempo are displayed a short time and at the start so a user is able to know the rhythm and tempo very correctly.

Further, when a battery cell is used as the power source a life of it is prolonged since current comsumption of the present invention is very low.

What is claimed is:

1. An electronic metronome including: a tempo signal generator for generating a predetermined frequency tempo signal; means including a monostable multivibrator for developing an up beat signal and a down-beat pulse signal having a predetermined pulse length greater than the pulse length of the up beat signal from the tempo signal; and sound generating means responsive to a tempo-acoustic signal for generating sounds in response thereto, said sound generating means comprising a tempo-acoustic control circuit responsive to the down-beat signal and up beat signal for controlling the generated sounds according to the down-beat and up beat signals to distinguish the down-beat from the up beat by duration.

2. An electronic metronome as claimed in claim 1, further comprising a pair of visual display elements; first means responsive to the down-beat signal for enabling one of said indicator elements to visually indicate down-beat for a time interval determined by the pulse length of the down-beat signal; and second means responsive to the up beat signal for enabling the other of said indicator elements to visually indicate up beat for a time interval determined by the pulse length of the up beat signal.

3. An electronic metronome, comprising: a tempo signal generator for generating a predetermined frequency tempo signal; down-beat signal generating means for developing a down-beat signal from the tempo signal; and tempo-acoustic tone generating means responsive to the tempo signal and the down-beat signal for generating an acoustic tempo tone signal at the predetermined tempo frequency and having a first tone to indicate the down-beat and a second tone to indicate an up-beat, wherein said tempo-acoustic tone generating means is comprised of a controllable oscillator receptive of and responsive to the down-beat signal for developing an output signal having a first frequency corresponding to the first tone of the tempo-acoustic tone signal in response to the down-beat signal and for developing an output signal having a second frequency corresponding to the second tone of the tempo-acoustic tone signal in the absence of the down-beat signal; an acoustic signal generator responsive to the output signal of the controllable oscillator for developing the tempo-acoustic tone signal having either the first or the second tone according to the frequency of the output signal of said controllable oscillator; and control circuit means receptive of and responsive to the tempo and down-beat signals for applying the output signal of said controllable oscillator at the first frequency during the occurrence of the down-beat signal to develop the tempo-acoustic signal at the first tone during the occurrence of the down-beat signal and for applying the output signal of said controllable oscillator at the second frequency during the occurrence of the tempo signal other than during the occurrence of the down-beat signal to develop the tempo-acoustic signal at the second tone during the occurrence of the up-beat.

4. An electronic metronome according to claim 3, wherein said control circuit means is comprised of: a transistor; and biasing means responsive to the tempo signal and the down-beat signal for normally biasing said transistor in a non-conductive state and for biasing said transistor in a conductive state in response to the tempo signal and the down-beat signal; wherein said transistor is connected for receiving the output signal from said controllable oscillator and for applying the same to said acoustic signal generator when said transistor is conductive.

5. An electronic metronome according to claim 4, wherein said biasing means includes a capacitor effective for gradually reducing the conductivity of said transistor when the tempo signal and the down-beat signal terminate and said transistor changes from the conductive to the non-conductive state.

6. An electronic metronome according to claim 3, wherein said acoustic signal generator comprises a loud speaker.

7. An electronic metronome comprising: a tempo signal generating means having an output; a down-beat signal generating means connected with said output of said tempo signal generating means, said down-beat signal generating means receiving a tempo signal from said tempo signal generating means and generating a down-beat signal therefrom; an indicator driving circuit connected to said tempo signal generating means and to said down-beat signal generating means and receiving signals therefrom, said indicator driving circuit having first and second outputs; a first LED and a second LED connected respectively to said first and second outputs of said indicator driving circuit, said indicator driving circuit energizing said first LED to make it conduct when said indicator driving circuit receives only said tempo signal and energizing said second LED to make it conduct when said indicator driving circuit receives both said tempo signal and said down-beat signal; and rhythm tone generating means responsive to the tempo signal and the down-beat signal for generating an acoustic rhythm tone pulse signal having different pulse durations to distinguish between down-beat and up-beat.

8. An electronic metronome according to claim 7, wherein said rhythm tone generating means is effective for generating an acoustic rhythm tone pulse signal having different tones to distinguish between down-beat and up-beat.

9. An electronic metronome including: a tempo signal generator for generating a predetermined frequency tempo signal; means for developing a predetermined down-beat pulse signal and up beat pulse signal from the tempo signal, and including means for making a pulse length of the down-beat signal different from that of the up beat signal; sound generating means responsive to a tempo-acoustic signal for generating sounds in response thereto, said sound generating means comprising a tempo-acoustic control circuit responsive to the down-beat signal and up beat signal for controlling the generated sounds according to the down-beat and up beat signals to distinguish the down-beat from the up beat by duration; a pair of visual display elements; first means responsive to the down-beat signal for enabling one of said indicator elements to visually indicate down-beat for a time interval determined by the pulse length of the down-beat signal; and second means responsive to the up beat signal for enabling the other of said indicator elements to visually indicate up beat for a time interval determined by the pulse length of the up beat signal.

* * * * *